United States Patent [19]

Duncan

[11] 3,958,923

[45] May 25, 1976

[54] COMBINED KILN AND LID PROP

[75] Inventor: Richard F. Duncan, Fresno, Calif.

[73] Assignee: Duncan Enterprises, Fresno, Calif.

[22] Filed: June 12, 1975

[21] Appl. No.: 586,418

Related U.S. Application Data

[63] Continuation-in-part of Ser. No. 509,425, Sept. 26, 1974, abandoned.

[52] U.S. Cl. ..... 432/250; 110/173 R; 126/191

[51] Int. Cl.[2] ..... F27D 1/18

[58] Field of Search ..... 217/60 R, 60 B, 60 E, 217/61; 432/250; 126/191; 49/90; 110/173, 176

[56] References Cited

UNITED STATES PATENTS

| | | | |
|---|---|---|---|
| 1,646,213 | 10/1927 | Otis | 110/176 |
| 2,253,707 | 8/1941 | Hoke | 432/250 |
| 2,473,624 | 6/1949 | Weyenberg et al. | 217/60 B |
| 2,646,302 | 7/1953 | Viola | 217/60 R |

*Primary Examiner*—John J. Camby
*Attorney, Agent, or Firm*—Huebner & Worrel

[57] ABSTRACT

A combined kiln and lid prop in which the kiln has an upwardly opening lid pivotally mounted thereon, said prop being pivotally mounted on the kiln and having an upwardly extended propping position in which it is releasably retained by resting the lid thereon, an outward reclining position, and a center of gravity in the propping position outward of the pivotal mounting thereof so that the prop automatically pivots to the reclining position when the weight of the lid is removed therefrom allowing the lid fully to close.

12 Claims, 8 Drawing Figures

COMBINED KILN AND LID PROP

CROSS REFERENCE

This application is a continuation-in-part of United States patent application Ser. No. 509,425, filed Sept. 26, 1974 with which it is copending, and now abandoned.

BACKGROUND OF THE INVENTION

The present invention relates to a combined kiln and lid prop and more particularly to such a combination in which a lid prop is pivotally mounted on the side of an upright kiln having an upwardly opening lid for pivotal movement between an upright position with the lid pivotally rested thereon and an outwardly and downwardly pivoted position, the prop having a center of gravity outward of its pivotal mounting so that when the lid is lifted from the prop the latter automatically pivots away from the lid allowing closure thereof. In a second form of the invention, the lid has a manipulating handle having an opening therein and the prop has an extended portion releasably fitted to the handle opening when in propping position.

There are many varieties of kiln structures used in firing ceramic materials having a wide range of sizes. The type of kiln involved in the present invention is that employed in the home, laboratory or other location to fire ceramic ware of artistic and/or functional nature which is small enough and light enough for manual formation and positioning. The kiln is typified by those used by hobbiests.

In the making of ceramic articles, a suitable clay or other ceramic raw material is first mixed with sufficient water to give it plasticity. This normally requires the material to contain from 15 to 25 percent water by weight.

The plastic raw material is then formed by hand molding, jiggering, extrusion, pressing, or casting. Once this is accomplished, the formed object has its excess water removed in a dryer or kiln. In fact, whether predried in a dryer or sent directly to a kiln, it is the normal practice when the object reaches the kiln to leave the kiln open for several hours to permit ventilation and evaporation of excessive moisture. The kiln is normally heated during such period to facilitate evaporation although care is exercised to avoid cracking due to a too rapid rate of drying.

Conventionally, the kiln is held open by placing a brick or other obstruction under the lid of the kiln, which brick is removed when the drying cycle is completed. Unfortunately, kilns are normally lined with a soft pumice insulation. The engagement of bricks with such insulation wears away the insulation and the bricks causing premature deterioration of the kilns and particles from the worn insulation and the bricks enter the kilns damaging the soft objects being dried therein. Further, this primitive but customary procedure requires an attendant to use both hands in propping or unpropping kiln lids.

It has long been recognized that the provision of improved means for propping open the lids of kilns which do not subject the objects undergoing firing to contamination nor impair the kiln insulation would be of considerable practical advantage.

BRIEF SUMMARY OF THE INVENTION

In view of the foregoing, it is an object of the present invention to provide an improved combined kiln and lid prop which avoids contamination of articles being fired in the kiln.

Another object is to provide a lid prop which is integral with such a kiln.

Another object is to provide a lid prop for a kiln which has no wearing effect on the kiln insulation.

Another object is to provide a lid prop for a kiln which is not a source of contamination for articles fired in the kiln.

A further object is to provide a lid prop for a kiln which is operable with one hand.

Another object is to provide such a lid prop which is releasably held in propping position by resting the lid thereon and which automatically withdraws from its propping position by a brief upward lift on the lid.

These and other objects will become more fully apparent upon reference to the following description and accompanying drawings.

DESCRIPTION OF THE PREFERRED EMBODIMENTS

Figure 1:
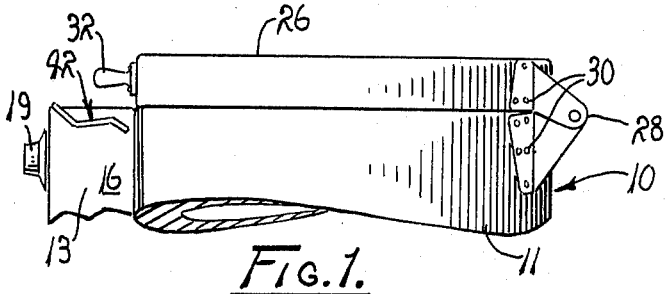
FIG. 1 is a fragmentary side elevation of a kiln, showing a combination kiln and lid prop embodying the principles of the instant invention with the prop in a reclining position.

Referring more particularly to the drawings, a fragment of a kiln is shown generally at 10 in FIG. 1, having an upright cylindrical oven 11 with a circular edge 12. Attached to the oven is an upright rectangular control box 13 with vertical sides 16 and a temperature control knob 19 disposed outwardly from the oven. Resting atop the oven is a lid 26 pivotally mounted on the oven by hinges 28 secured by screws 30 for movement about an axis tangential to the oven between a fully open position, not shown, a partially open ventilating position shown in FIGS. 2 and 4 and a closed position shown in FIGS. 1 and 3. Attached to the lid is a horizontally disposed handle 32 for lifting the lid which is secured to the lid by screws 34. As described, the kiln is of well-known form.

Figure 2:
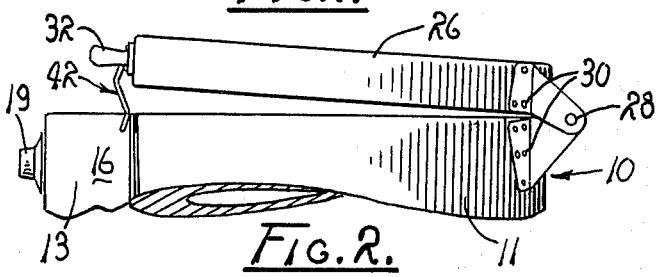
FIG. 2 is a view similar to that of FIG. 1, but with the prop supporting the lid of the kiln.
Figure 3:
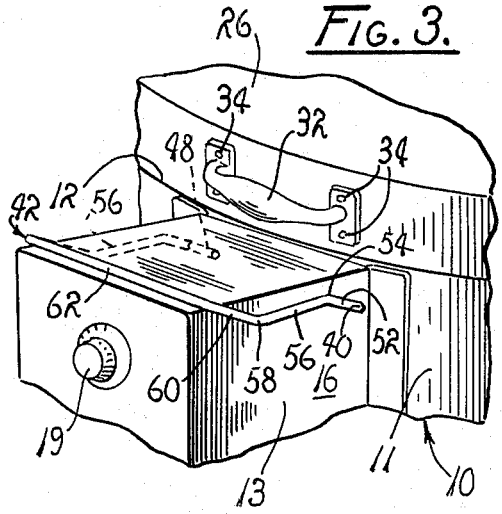
FIG. 3 is a somewhat enlarged fragmentary perspective view of the combination of FIG. 1 with the prop reclined.
Figure 4:
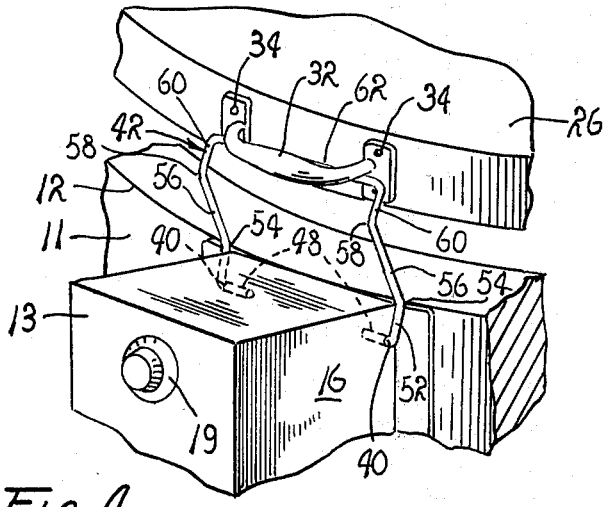
FIG. 4 is a fragmentary view similar to that of FIG. 3 but with the prop supporting the lid.
Figure 5:
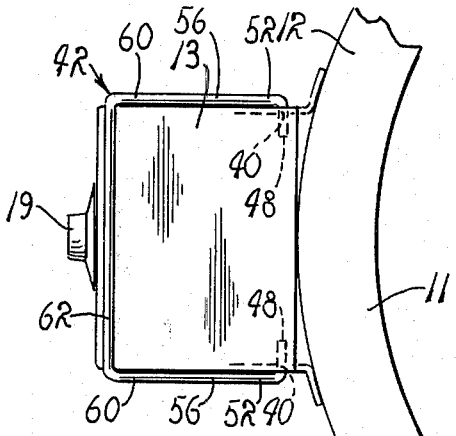
FIG. 5 is a fragmentary top plan view of the combination of FIG. 1 showing the prop reclined and a portion of the lid.
Figure 6:
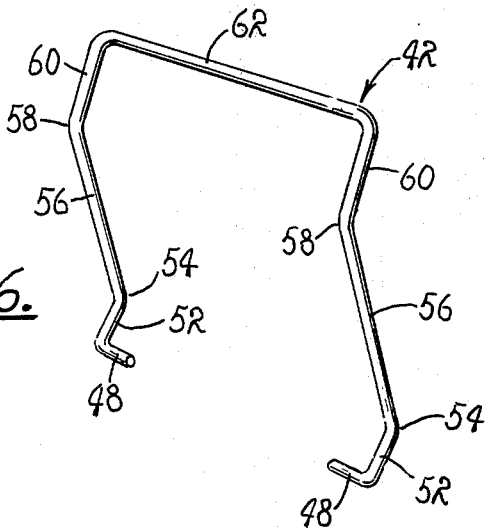
FIG. 6 is a perspective view of the prop of the present invention.

Aligned bores 40 are drilled in the opposite sides 16 of the control box 13 near the upper ends thereof. Mounted on the box 13 is a lid prop 42 formed of a metal rod of circular cross section to attain the shape of a bail or hoop having two axially aligned pins 48 orthogonal to the vertical sides of the box, directed inwardly of the box and pivotally seated in the bores 40 so as to form a pivotal axis substantially parallel to the axis of the lid. Connected to the outer ends of pins are two parallel straight legs 52 formed at right angles to the pins and disposed in respective planes parallel to the sides 16. As best seen in FIG. 6, two knees 54 disposed in parallel planes angularly connect the legs 52 to a second pair of parallel legs 56 forming an acute angle between the legs 52 and 56. A second pair of knees 58 disposed in parallel planes connect the second pair of legs 56 to a third pair of parallel legs 60 forming an acute angle between legs 56 and 60 in the opposite direction to the angle between legs 52 and 56 so that legs 52 and 60 are approximately parallel. A crosspiece 62 parallel to the pins 48 connects the two legs 60 so as to give the prop 42 a bail shape. The prop pivots in bores 40 between a reclining position on top of the control box 13, shown in FIGS. 1 and 3, and an upright position beneath the handle 32 so as to prop up the lid 26, as shown in FIGS. 2 and 4. The effect of the two angular knees 54 and 58 is to give the prop 42 a center of gravity outward from the pivotal axis through the bores 40 when the prop is in the upright position. When the prop is in propping position with the lid 26 rested thereon, only the weight of the lid maintains the prop in the upright position. When the weight of the lid is lifted from the prop the center of gravity of the prop pivots the prop outwardly from the lid and into the reclining position shown in FIGS. 1 and 3.

As best shown in FIGS. 2 and 4, the knees 54 engage the oven 11 as the prop 42 is pivoted upwardly so that the oven acts as a stop precluding movement of the prop inwardly beyond propping position.

SECOND FORM

Figure 7:
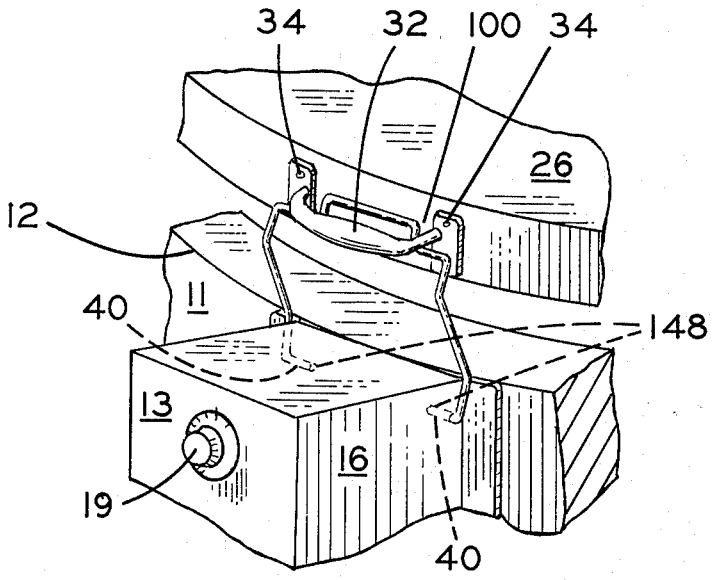
FIG. 7 is a fragmentary perspective view similar to FIG. 4 but showing a second form of the invention.
Figure 8:
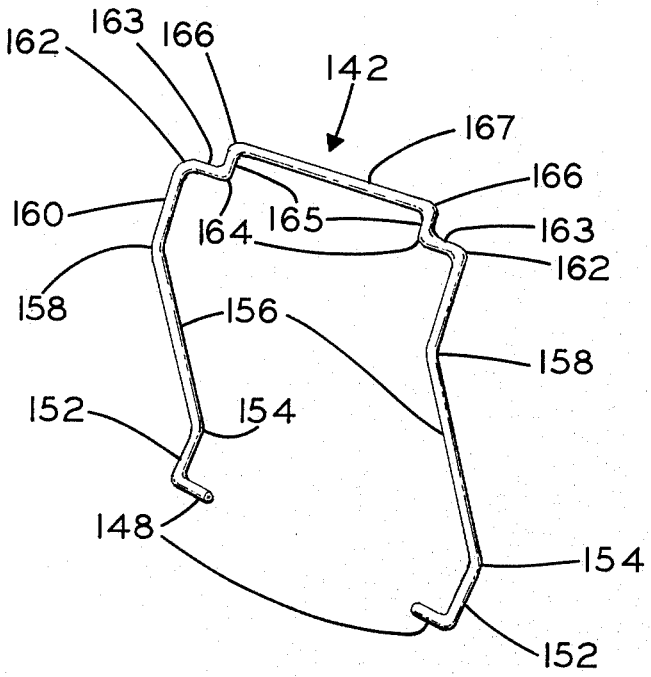
FIG. 8 is a perspective view of a prop of the second form of the invention.

A second form of the present invention is illustrated in FIGS. 7 and 8. The kiln and its components shown in FIG. 7 are identified by the same reference numerals as those employed in the earlier figures illustrating the first form of the invention. It will be noted that the handle 32 in FIG. 7 defines an opening 100 to which reference will subsequently be made.

The second form of lid prop is shown at 142 having aligned pins 148 rotatably received in the bores 40. As before, the prop is conveniently made of a single metal rod in the shape of a bail. Individually connected to the outer ends of the pins are two substantially parallel straight legs 152 right-angularly related to the pins. As best shown in FIG. 8, two knees 154 disposed in said parallel planes angularly connect the first legs 152 to a second pair of parallel legs 156 forming an acute angle between the legs 152 and 156. A second pair of knees 158 individually disposed in said parallel planes connect the second pair of legs 156 to a third pair of parallel legs 160 forming an acute angle between the legs 156 and 160 in the opposite direction to the angle between the legs 152 and 156 so that the legs 152 and 160 are approximately parallel. It will be noted that the legs 152, 156 and 160 together with the knees 154 and 158 are disposed in respective parallel planes parallel to the sides 16. Third knees 162 integral with the outer ends of the third legs 160 are inwardly turned and mount space aligned legs 163. Fourth knees 164 continuous with the fourth legs 163 are outwardly extended and mount fifth legs 165 substantially radially extended from the axis of the pins 148. The outer ends of the fifth legs 165 mount inwardly directed fifth knees 166 which are interconnected by a straight sixth leg 167.

As before, the prop 142 pivots in the bores 140 between a reclining position on top of the control box 13, not shown, and an upright position beneath the handle 32 with the fifth legs 165 and fifth knees 166 fitted to the opening 100 defined by the handle. In such propping position, the handle 32 and thus the lid 26 are rested on the fourth legs 163. The effect of the angular knees 154 and 158 is to give the prop 142 a center of gravity outward from the pivot axis defined by the bores 40 when the prop is in upright propping position. When the handle 32 is lifted from the prop sufficiently that the sixth leg 167 can escape from the opening 100, the prop gravitationally pivots outwardly to its reclining position.

When the prop 142 is in propping position, the knees 154 engage the oven 11 so that as the prop is pivoted upwardly, the oven acts as a stop aligning the fifth legs 165 with the opening 100 so that the handle can be slid downwardly thereover dependably to hold the prop in propping position.

OPERATION

The operation of the combinations of kiln and lid prop of the present invention is believed to be clearly apparent and is briefly summarized at this point. When clay or other ceramic material, not shown, has been prepared for firing by forming it in a plastic state, it is inserted into the kiln 10 for drying and subsequent firing. During the drying phase, which can last several hours, the kiln must have some vent to allow moisture to escape. In the present invention the venting is accomplished by propping the lid 26 in a semi-open position as shown in FIGS. 2, 4 and 7 by opening the lid by lifting upwardly on handle 32, raising the prop 42 or 142 to its upright position, and gently lowering the lid while holding the prop upright until the handle rests on the upright prop thereby securing it in that position. In actual practice, it is found that this can be done with one hand. In the second form of the invention, the handle slides downwardly over the fifth legs 165 dependably to capture the upper end portion of the prop in the opening of the handle with the handle and lid rested on the shoulders formed by the third knees 162 and fourth legs 163.

The kiln is heated at the desired temperature for the duration of the predetermined drying period. At the end of the drying when venting is no longer needed the lid 26 can be closed by simply lifting upwardly slightly on handle 32. The centers of gravity of the props 42 and 142 exert a force on their respective props so as to pivot them from their upright positions into their reclined positions. The lid is then free to be lowered to its fully closed position, as seen in FIGS. 1 and 3.

The present invention thus allows the venting of a conventional top-opening kiln without the hazard of introducing foreign matter into the kiln. At no time does the prop 42 or 142 engage insulation of the kiln 10 and thus in no way does it wear or damage the insulation nor cause the insulation to discharge particles into the kiln. The prop cannot be the source of contaminating particles nor can it be inadvertently dropped into the kiln as can a brick used for propping purposes. The props allow instant closure of the kiln after venting by a slight upward movement on the handle 32, with one hand, after which the props 42 and 142 automatically retract allowing the lid 26 to be closed.

Thus, it will be seen that the present invention permits single handed operation in propping and unpropping the lid 26. Contamination is avoided. Dependable propping is achieved. The props 42 and 142 are economical to produce, duruable and easily installed.

Although the invention has been herein shown and described in what are conceived to be the most practical and preferred embodiments, it is recognized that departures may be made therefrom within the scope of the invention, which is not to be limited to the illustrative details disclosed.

Having described my invention, what I claim as new and desire to secure by Letters Patent is:

1. In combination with a kiln having an oven providing an open upper end, a lid pivotally mounted on the kiln for movement about a fixed axis adjacent to the oven between a substantially horizontal closed position and an open position upwardly therefrom, and means integral with the lid having an arcuate path of movement as the lid is moved between open and closed positions; a lid prop mounted on the kiln adjacent to the oven at the side thereof opposite to said axis and upwardly extended for pivotal movement between a position disposed in the path of movement of said means to support the lid thereon and a position outwardly thereof.

2. The combination of claim 1 in which the lid prop has a pivotal axis substantially parallel to the lid axis and a center of gravity outwardly of the pivotal axis of the prop in both of said positions tending to urge the prop into its outer position.

3. The combination of claim 2 including a stop integral with the kiln engageable with the prop to limit inward pivotal movement of the prop from the path of movement of said means.

4. The combination of claim 1 in which the means integral with the lid is a handle having an opening therethrough and the prop has a portion releasably fitted to the opening in the handle when the prop is in propping position and contiguous portions substantially parallel to the pivotal axis of the prop on which the handle is rested to support the lid in open position when said portion of the prop is fitted to the opening of the handle.

5. In combination with a kiln having an oven providing an open upper end, a lid pivotally mounted on the oven for movement about a substantially horizontal axis at a side of the oven between a substantially horizontal closed position over the open upper end of the oven and an open position upwardly therefrom, and a handle mounted on the lid having an arcuate path of movement as the lid is moved between open and closed positions; a lid prop mounted on the kiln for pivotal movement about an axis substantially parallel to the axis of the lid inwardly of the path of movement of the handle and having an extended end, the prop being pivotal between a propping position with its extended end in the path of movement of the handle and a retracted position outwardly thereof, and having a center of gravity outwardly of its axis in both of said pivotal positions; and a stop on the kiln engageable by the prop when the prop is in propping position to limit inward pivotal movement of the prop.

6. The combination of claim 5 in which the handle is of bail form defining an opening therein and the extended end of the prop has a portion which extends into said opening of the handle when the prop is in propping position and the lid is lowered thereon whereby the prop is releasably captured by the handle.

7. In combination with a kiln having an oven providing an open upper end circumscribed by an edge, a lid pivotally mounted on the oven for movement about a substantially horizontal axis adjacent to the oven between a substantially horizontal closed position engaged with the edge and an open position upwardly therefrom, and a handle mounted on the lid opposite to the oven from said axis and having an arcuate path of movement as the lid is moved between open and closed positions; a lid prop mounted on the kiln for pivotal movement about an axis substantially parallel to the axis of the lid and opposite to the oven therefrom inwardly of the path of movement of the handle having a substantially straight leg radially extended upwardly from the axis, an angular knee continuous with the leg, a second substantially straight leg continuous with the knee outwardly and upwardly extended from the knee, a second angular knee continuous with the second leg, and a third substantially straight leg continuous with the second knee upwardly extended therefrom, the prop being pivotal between a propping position with its upper end in the path of movement of the handle and a retracted position outwardly thereof, and having a center of gravity outwardly of its axis in both of said pivotal positions, the first knee being engageable with the oven when the prop is in propping position to limit inward pivotal movement of the prop.

8. The combination of claim 7 in which the prop comprises a bail having axially aligned ends pivotally engaged with the kiln, said continuous leg, knee, second leg, second knee, and third leg are duplicated on opposite sides of the bail and on each side of the bail are continuous with said ends, and the third legs are interconnected by a substantially straight portion substantially parallel to said ends.

9. In combination with a kiln having a substantially cylindrical oven providing an open upper end circumscribed by a substantially circular edge, a lid pivotally mounted on the oven for movement about a substantially horizontal axis substantially tangential to the oven between a substantially horizontal closed position engaged with the edge and an open position upwardly therefrom, and a handle mounted on the lid having an arcuate path of movement as the lid is moved between open and closed positions; a lid prop mounted on the kiln for pivotal movement about an axis substantially parallel to the axis of the lid inwardly of the path of movement of the handle having a substantially straight leg radially extended upwardly from the axis, an angular knee continuous with the leg, a second substantially straight leg continuous with the knee outwardly and upwardly extended from the knee, a second angular knee continuous with the second leg, and a third substantially straight leg continuous with the second knee upwardly extended therefrom, the prop being pivotal between a propping position with its upper end in the path of movement of the handle and a retracted position outwardly thereof, and having a center of gravity outwardly of its axis in both of said pivotal positions; and a stop mounted on the oven engageable by the first knee when the prop is in propping position to limit inward pivotal movement of the prop.

10. The combination of claim 9 in which the prop comprises a bail having axially aligned ends pivotally engaged with the kiln, said continuous leg, knee, second leg, second knee, and third leg are duplicated on opposite sides of the bail and on each side of the bail are continuous with said ends, and the third legs are interconnected by a substantially straight portion substantially parallel to said ends.

11. The combination of claim 9 in which the prop comprises a bail having axially aligned ends pivotally engaged with the kiln, said continuous leg, knee, second leg, second knee and third leg are duplicated on opposite sides of the bail and on each side of the bail are continuous with said ends, and the third legs are interconnected by inwardly bent third knees continuous with the third legs, aligned fourth legs individually continuous with the third knees and inwardly extended therefrom, outwardly bent fourth knees individually continuous with the fourth legs, fifth legs individually continuous with the fourth knees and substantially radially extended from the axis of the prop, inwardly bent fifth knees individually continuous with the fifth legs, and a straight sixth leg interconnecting the fifth knees.

12. The combination of claim 11 in which the handle of the lid has an opening therethrough to which the fifth legs are fitted when the prop is in propping position with the handle rested on the fourth legs.

* * * * *